US012507773B2

(12) United States Patent
Meggitt et al.

(10) Patent No.: US 12,507,773 B2
(45) Date of Patent: Dec. 30, 2025

(54) FRONT OPENING FLEXIBLE CONTAINER

(71) Applicant: Coolside Limited, Glasgow (GB)

(72) Inventors: Ryder Magnus Iain Meggitt, Hillend (GB); Eilidh Alexandra Earle-Mitchell, Glasgow (GB); Jonathan Ian Campbell, Glasgow (GB)

(73) Assignee: Coolside Limited, Glasgow (GB)

( * ) Notice: Subject to any disclaimer, the term of this patent is extended or adjusted under 35 U.S.C. 154(b) by 968 days.

(21) Appl. No.: 17/627,550

(22) PCT Filed: Jul. 17, 2020

(86) PCT No.: PCT/GB2020/051721
§ 371 (c)(1),
(2) Date: Jan. 14, 2022

(87) PCT Pub. No.: WO2021/014130
PCT Pub. Date: Jan. 28, 2021

(65) Prior Publication Data

US 2022/0256988 A1 Aug. 18, 2022

(30) Foreign Application Priority Data

Jul. 19, 2019 (GB) ..... 1910361

(51) Int. Cl.
*A45C 3/00* (2006.01)
*A45C 7/00* (2006.01)
(Continued)

(52) U.S. Cl.
CPC ..... *A45C 3/001* (2013.01); *A45C 7/0095* (2013.01); *A45C 13/02* (2013.01); *A45C 13/103* (2013.01);
(Continued)

(58) Field of Classification Search
CPC ..... A45F 3/04; A45F 3/02; A45F 2200/05; A45F 4/02; A45C 3/00; A45C 3/004; A45C 13/103
See application file for complete search history.

(56) References Cited

U.S. PATENT DOCUMENTS 3,115,959 A * 12/1963 Jaffe ..... A45C 3/004 383/66
3,244,261 A * 4/1966 Herz ..... A47G 25/54 190/111
(Continued)

FOREIGN PATENT DOCUMENTS

CN 2291819 Y 9/1998
CN 102247045 A 11/2011
(Continued)

OTHER PUBLICATIONS

European Patent Office, Examination Report in EP 20751198.1, dated Jan. 26, 2023.
(Continued)

*Primary Examiner* — Corey N Skurdal
(74) *Attorney, Agent, or Firm* — Dorton & Willis LLP; Ryan Willis

(57) ABSTRACT

A container (10, 100) manufactured from flexible material comprises a body (12) extending from a base (14). The body (14) defines an interior space configured to contain one or more objects and is configurable between an extended configuration and a folded configuration. The body includes a front opening, which includes an elongate closure member (16) extending from a point proximate an uppermost edge (18) of the body in the extended configuration to a point proximate the base (14). The closure member (18) bridges two side portions (26) of the body (16) such that when the closure member (18) is at least partially open the two side
(Continued)

portions (26) are displaceable relative to each other, towards a rear wall (20), to provide access to inside the body and any contents contained therein.

33 Claims, 17 Drawing Sheets

(51) Int. Cl.

| | |
|---|---|
| ***A45C 13/02*** | (2006.01) |
| ***A45C 13/10*** | (2006.01) |
| ***A45C 15/06*** | (2006.01) |
| ***A45F 3/02*** | (2006.01) |

(52) U.S. Cl.
CPC ..... *A45C 15/06* (2013.01); *A45F 3/02* (2013.01); *A45C 2003/002* (2013.01); *A45C 2013/026* (2013.01)

(56) References Cited

U.S. PATENT DOCUMENTS

| | | | | |
|---|---|---|---|---|
| 4,189,036 | A * | 2/1980 | Pelavin | A47G 25/54 206/278 |
| 4,927,014 | A * | 5/1990 | Pulichino, Jr. | A45C 3/004 206/293 |
| 2002/0038811 | A1* | 4/2002 | Vigny | A45F 3/04 224/650 |
| 2005/0268548 | A1 | 12/2005 | Lovette et al. | |
| 2013/0220956 | A1 | 8/2013 | Carr et al. | |
| 2014/0069063 | A1 | 3/2014 | Edmonds | |
| 2017/0022640 | A1 | 1/2017 | Schenk et al. | |
| 2018/0252458 | A1 | 9/2018 | Fumeaux et al. | |

FOREIGN PATENT DOCUMENTS

| | | | |
|---|---|---|---|
| CN | 204 674 801 | | 9/2015 |
| CN | 207693109 | U | 8/2018 |
| CN | 202080066131.3 | | 10/2024 |
| DE | 29 810 107 | | 10/1999 |
| EP | 3 078 771 | | 10/2016 |
| GB | 965905 | | 8/1964 |
| GB | 2435417 | | 8/2007 |
| JP | S53 87000 | | 7/1978 |
| JP | S5910622 | U | 1/1984 |
| JP | H0189020 | U | 6/1989 |
| JP | H0440821 | U | 4/1992 |
| JP | H04120618 | U | 10/1992 |
| JP | 3201978 | U | 1/2016 |
| JP | 2016198495 | | 12/2016 |
| JP | 2022-503550 | | 2/2024 |

OTHER PUBLICATIONS

European Patent Office, Examination Report in EP 20751198.1, dated Sep. 28, 2023.

Amazon UK, 2018, 'Under Armour Women's Essentials Sack Pack', [online], Available from: https://amazon.co.uk/Under-Armour-Womens-Essentials-Radio/dp/B077KJFVV6/ref=sr_1_42?dchild=1 . . . .

* cited by examiner

FRONT OPENING FLEXIBLE CONTAINER

This application is a national stage of PCT/GB2020/051721, filed Jul. 17, 2020, which claimed priority to Great Britain patent application number 1910361.3, filed Jul. 19, 2019, all of which are incorporated by reference.

FIELD OF THE INVENTION

The present invention relates to a container made of flexible material, for example textile material. The container has many uses, one such use being a packing capsule to assist in organising/compartmentalising items of clothing, toiletries etc. in, for example a suitcase. In particular, the packing capsule according to a described embodiment of the invention provides a versatile solution to packing and unpacking.

BACKGROUND TO THE INVENTION

Packing cubes simplify the process of packing and unpacking. Typically, packing cubes are fabric bags structured as a cube/cuboid with a zip around three sides of the upper edge to define a liftable lid to allow access to inside the cube and to allow filling with clothes, accessories etc. The shape and form of a packing cube is similar to the shape and form of the suitcase in which it is to be received. The scale of the packing cube, compared to a suitcase, is smaller such that multiple cubes can be arranged is inside the suitcase.

Packing cubes facilitate tidier, more organised packing and typically allow a user to organise the contents of their luggage, in a manner such that finding and accessing the contents of a suitcase is much easier than packing directly into the suitcase.

Packing cubes are available in various sizes, for example, small, medium and large or can be defined by volume. This means a user can select a packing cube according to the objects/items to be packed in the cube and according to the size of the suitcase/bag in which the packing cube is to be inserted. It will be appreciated that, typically multiple packing cubes, all of the same size or of various sizes, can be filled with appropriate items and then organised in a suitcase to make efficient use of the space available and facilitates easy access to each packing cube and the contents therein.

To efficiently use packing cubes, as noted above, various sizes can be selected and each cube can be filled with clothes, electronics, toiletries etc.

Using packing cubes allows a user to choose a packing strategy and leads to better organised packing, where items are easily identified and easily accessed compared to a conventional suitcase; by adopting a packing strategy using packing cubes it is less likely that a user will overpack their suitcases.

SUMMARY OF THE INVENTION

An aspect of the present invention provides a container of flexible material comprising:

- a body extending from a base, wherein the body defines an interior space configured to contain one or more objects;
- wherein the body is configurable between an extended configuration and a folded configuration;
- the body includes a front opening, which includes an elongate closure member extending from a point proximate an uppermost edge of the body in the extended configuration to a point proximate the base, wherein the closure member bridges two side portions of the body such that when the closure member is at least partially open the two side portions are displaceable relative to each other to provide access to inside the body.

The two side portions may be operable to be folded back on themselves to allow access to inside the body.

The closure member may extend across the base to a point proximate a rear wall, such that when the closure member is fully open the two side portions rotate relative to each other and towards the rear wall to provide access inside the body.

The uppermost edge of the body, in an extended configuration, may include a fastener. The fastener may comprise a hook. The fastener may comprise a G-hook. Alternatively, the fastener may comprise a buckle, for example a side release buckle, a cam buckle, belt buckle, a spring-loaded buckle etc. Alternatively, the fastener may comprise press studs or hook and loop fastener.

The fastener may be multi-functional in that it may, for example facilitate:

- hanging the container from a hook, a door hook, rail etc.;
- locking the closure member against inadvertent opening;
- converting the container to a carry-bag, wherein a strap or strap assembly can be attached to the container via the fastener;
- shortening the container by folding the uppermost edge over the body and securing the uppermost edge, via the fastener, to a front-mounted element located near the base.

A rear wall of the container may comprise an elongate spinal member, wherein the elongate spinal member extends from a point proximate the base to the uppermost edge of the body. The elongate spinal member may extend from a point at least partially across the base to the uppermost edge of the body.

The elongate spinal member may comprise an elongate piece of flexible material. The elongate piece of flexible material may be doubled to define a loop at a first end and a two-layer construction along its length to a second end. The first end comprising the loop may emerge proximate the uppermost edge to be external to the body. The fastener may be attached to the loop.

The second end may be secured to the body. The elongate spinal member may be secured to the body at least at both ends. The elongate spinal member may be secured to the body at least partially along its length.

The second end may extend to a point at least partially across the base. The second end may be secured to the base.

The elongate spinal member reinforces the container body, where the elongate spinal member carries load whilst the container is suspended from a hook, rail etc. In addition, the elongate spinal member reinforces the container body such that at least one other container or other item can be suspended from a hanging container.

At least a lower portion of the rear wall may include a reinforcing member which extends across substantially the width of the rear wall. The reinforcing member is operable to prevent crumpling of the packing capsule when resting on its base or when other packing capsules are suspended from the one or two or more loops.

A base portion of the rear wall may include at least one external strap, where the at least one strap extends substantially vertically relative to the base, wherein the at least one strap is secured at least at two points, for example top and bottom, thereby defining a void between the strap and the base portion of the rear wall. The at least one strap may provide a suspension point for at least another container or another item to be suspended from the container.

The base portion of the rear wall may include a plurality of external straps, wherein one or more straps extend substantially vertically relative to the base, wherein each strap is secured at least at two points thereby defining a void between each strap and the base portion of the rear wall. Each strap may provide a suspension point for at least another container or another item to be suspended from the container. One or more straps may extend across the base portion.

An upper section of the rear wall may include a flexible loop external to the body proximate the uppermost edge. The flexible loop may emerge from the uppermost edge and is secured at one end to the body and includes a looped free end. The looped free end is configured to be engageable with the fastener thereby, when engaged, the fastener and looped free end create a doable and undoable loop, for example for hanging the container from a fixed object, such as a hanging rail. The flexible loop doubles as a handle by which the container can be easily handled or carried.

The container may comprise a columnar body, extending from the base.

The base may be rounded.

The base may be substantially circular.

The base may be substantially elliptic.

A rear portion of the base may be substantially flat, thereby defining a substantially flat rear wall extending up from the base.

A substantially flat rear wall facilitates placement of the container in a suitcase or the like and also facilitates placement of the container to rest against a flat surface or to be hung against a flat surface.

The rear wall may be tapered from the base portion to the uppermost edge, wherein the uppermost edge is narrower than the base.

The body may include a substantially continuous front surface, which is defined by a slope, which transitions to a substantially vertical wall extending up from the base. Transition from the slope to the substantially vertical wall may be provided by a curved section thereby providing the continuous front surface. The closure member is located substantially central on the front surface.

The body may be manufactured from at least one layer of flexible material. The body may include a body liner and a body outer.

When used, the reinforcing member may be sandwiched between the body liner and body outer. When included, the spinal member may be sandwiched between the body liner and body outer.

The body, when the container/body is made from a single layer of fabric, may be manufactured from 100% recycled polyester rip stop fabric. The body outer, when the body is made from at least a body outer and a body liner, may be manufactured from 100% recycled polyester rip stop fabric. The 100% recycled polyester rip stop fabric may be treated to be wipe-clean. The 100% recycled polyester rip stop fabric may be treated to be waterproof.

It will be appreciated, the body or body outer may be manufactured from other fabrics/materials, for example leather, organic fabrics, PVC, waterproof treated fabrics, semi-transparent mesh fabric, breathable/wicking fabrics etc.

The body liner may be manufactured from 100% recycled polyester artificial silk fabric. Other suitable fabrics for the body liner include: silk, cotton, rip-stop nylon, hemp cotton, cashmere, merino wool etc. The body liner may be manufactured from waterproofed material, for example PVC coated cotton such that moisture is contained within the container.

The body may include ventilation.

The container may further comprise internal compartments, partitions, pockets etc. The internal compartments, partitions or pockets allow objects to be arranged, organised and accessible.

The container may further comprise external compartments, pockets etc.

The container may comprise internal fasteners operable to restrain items located inside.

The container may further comprise a removable strap assembly, which includes at one end a fastener compatible with the fastener located at the uppermost edge of the rear wall and a fastener configured for forward or rear attachment to the container.

A container according to the first aspect of the present invention is configurable as a packing capsule for modular packing of a suitcase or the like.

The container, when used as a packing capsule is configured for efficient packing and unpacking a conventional suitcase. As a packing capsule, the arrangement of the front opening and the associated closure member means that the packing capsule does not require to be unpacked when removed from the suitcase because the base supports a packed packing capsule and the front opening facilitates access to the contents whilst the packing capsule stands on the base and without risk of the contents falling out.

The shape and form of the container is different from existing packing cubes and provides a more versatile packing solution than existing packing cubes.

The container according to the present invention may be used in other applications, for example industrial, medical, military, hobbyist, travel, household, etc.

BRIEF DESCRIPTION OF THE DRAWINGS

Examples of the invention will now be described, by way of example, with reference to the drawings, in which.

DESCRIPTION

Figures 1, 2, 3:
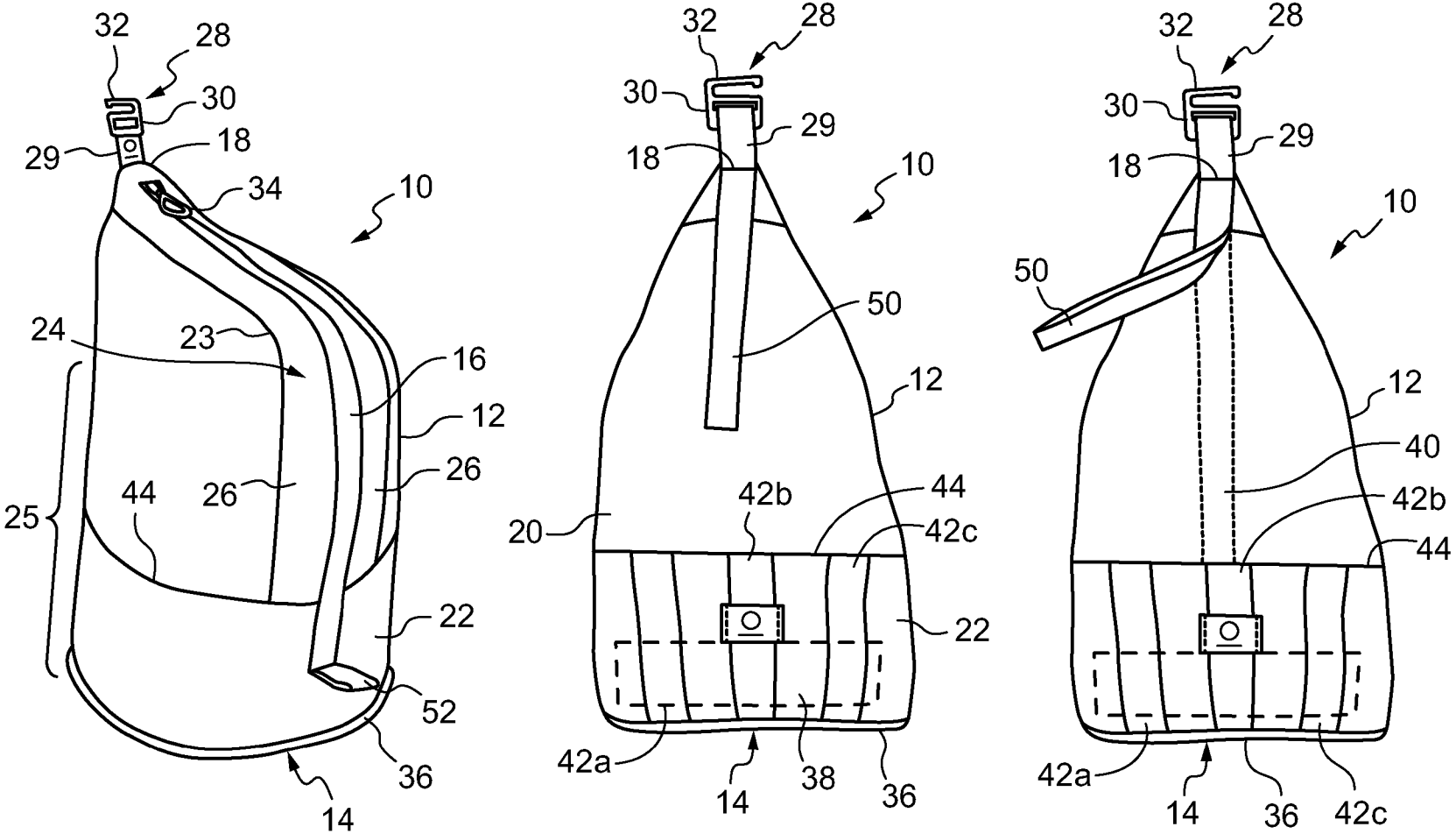
FIG. 1 illustrates a front perspective view of a container, which in the illustrated example is configured as a packing capsule.
FIG. 2 illustrates a rear view of the container illustrated in FIG. 1.
FIG. 3 illustrates a rear view of the container illustrated in FIGS. 1 and 2 and shows a concealed reinforced spine to the rear of the container.

FIGS. 1, 2 and 3 illustrate a container 10, or bag, which is made of flexible material (as described further below). An example application of the container 10 is that it is configurable as a packing capsule for efficient packing of suitcases and the like (see FIG. 7). The illustrated example of the container 10 can also be configured as a carry-bag, when combined with a suitable strap/strap assembly 48, as illustrated and described further below with reference to FIGS. 10, 11 and 12. A non-exhaustive list of alternative uses for the container 10 are described towards the end of this description.

In the illustrated example, the container 10 includes a substantially cylindrical body 12 which extends up from a base 14.

Figure 6B:
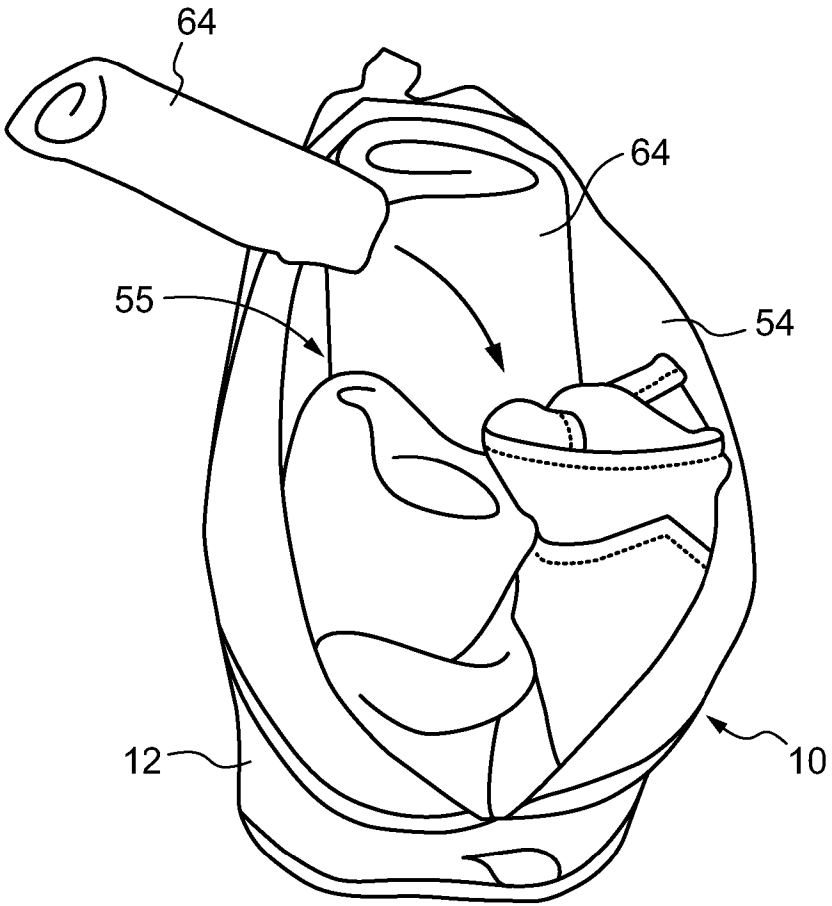
FIGS. 6*a* and 6*b* illustrate different sized containers containing example contents and illustrating how containers can be packed.
Figure 6A:
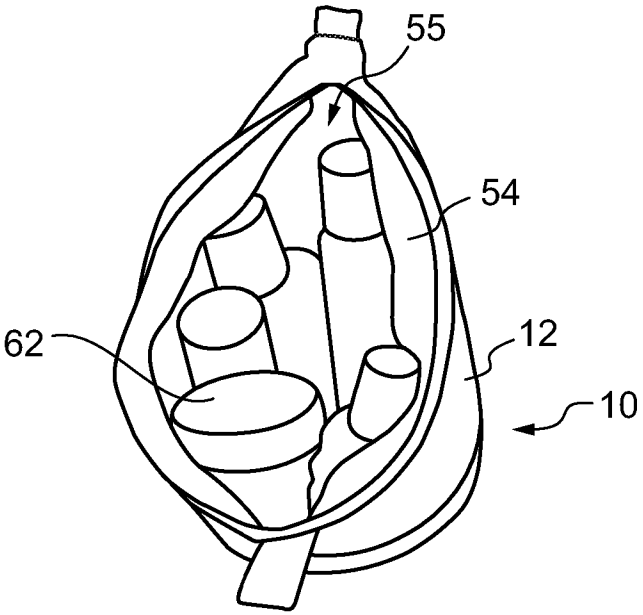

The cylindrical body 12 defines an interior space configured to contain one or more objects (see FIGS. 6*a* and 6*b*).

The interior space is accessed by a front opening, which is closed by a closure member 16, which, in the illustrated example is provided by a zip. The closure member 16 extends from a point close to the base 14 and ends at a point close to the uppermost edge 18 of the cylindrical body 12.

Referring to FIG. 2, the rear wall 20 of the cylindrical body 12 tapers from the base portion 22 to a narrowed uppermost edge 18 of the cylindrical body 12.

In the illustrated example, the front surface 24 of the container 10 is, substantially continuous, tapering from the uppermost edge 18 and transitioning by curve 23 to a substantially vertical portion 25 of the front surface 24, which extends to the base portion 22. The base portion 22, in the illustrated embodiment is the vertical section defined between the upper edge/seam-line 44 and the base 14.

The closure member 16 is positioned substantially central to the front surface 24.

The closure member 16, when open provides access to the interior space and any contents therein. When opened, the front opening is defined by two side walls 26, which fold back on themselves (see FIGS. 6*a* and 6*b*) to provide maximum access to the interior space, whilst adequately retaining any contents.

The uppermost edge 18, is formed by the junction of the rear wall 20 and the front surface 24. A loop 29 emerges from the uppermost edge 1. In the illustrated example a G-hook 28 is attached to the loop 29.

The G-hook 28 is a fastener which when viewed resembles a letter G or a number 6, where the lower closed/semi closed portion 30 of the G-shaped hook 28 is permanently attached to the container 10 via the loop 29 that passes through the lower closed/semi closed portion 30 of the G-shape.

Figure 9B:
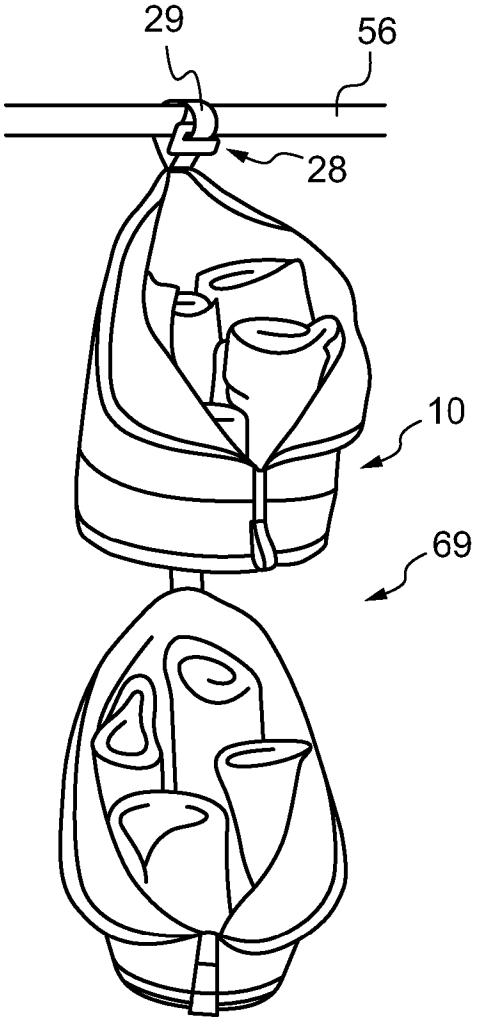
FIGS. 9*a* and 9*b* illustrate examples of multiple containers packed and open and where each is suspended, either from a rail or from another container, thereby providing easy access to the contents.
Figure 9A:
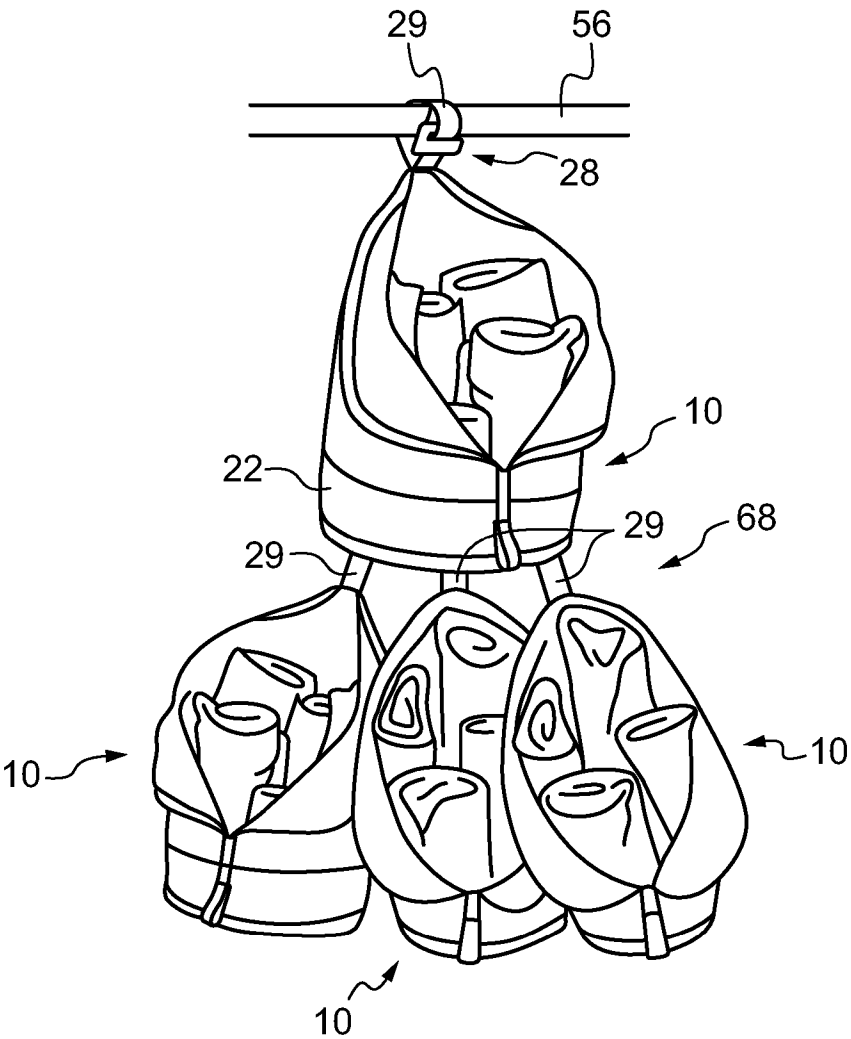
Figure 10:
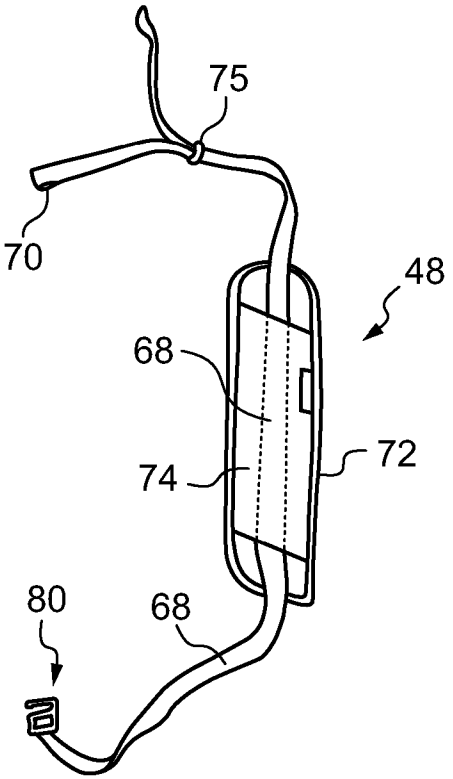
FIG. 10 illustrates an example of a strap assembly which converts the container of FIGS. 1 to 3 to a carry-bag.
Figure 11:
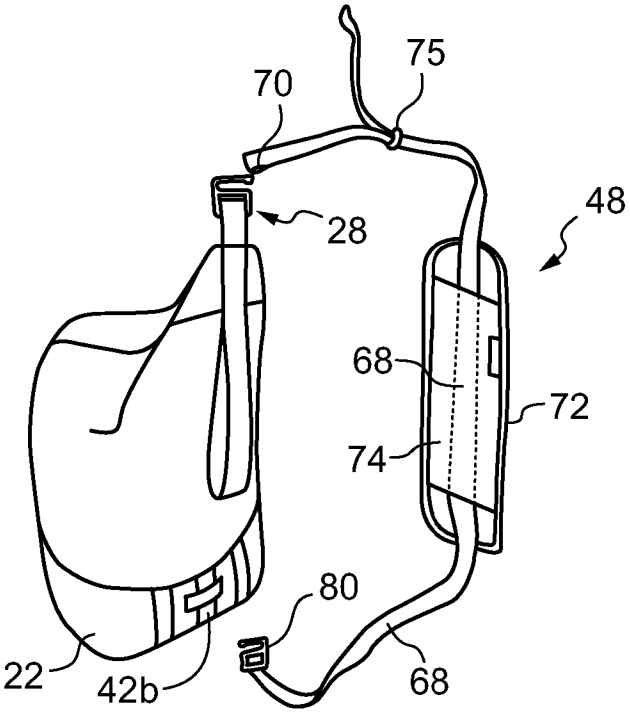
FIG. 11 illustrates the strap assembly of FIG. 10 being applied to the rear of the container as illustrated in FIG. 1.
Figure 12:
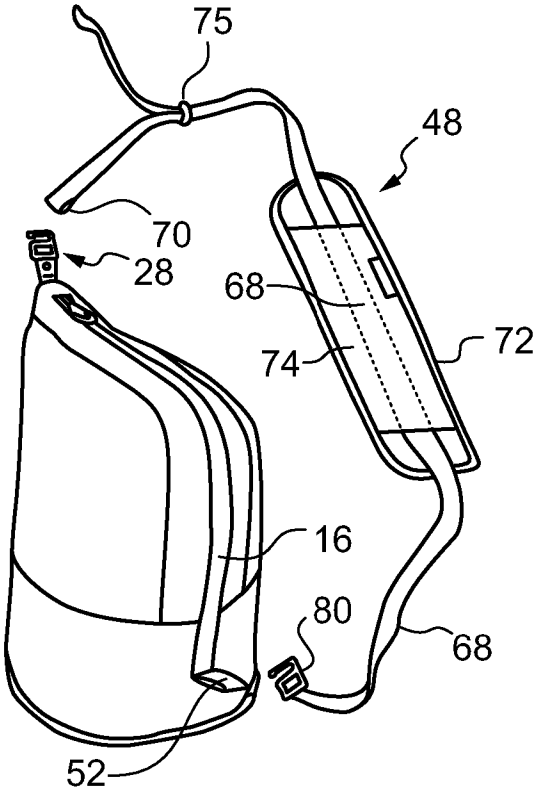
FIG. 12 illustrates the strap assembly of FIG. 10 being applied to the front of the container as illustrated in FIG. 1.

The upper hooked portion 32 of the G-shaped hook 28 facilitates hanging the container 10 (see FIGS. 4*a*, 4*b*, 4*c*, 9*a* and 9*b*), securing the zip pull 34 (see FIGS. 5*a*, 5*b*), reducing the size of the container 10 (see FIG. 8) and converting the container 10 to a carry-bag (see FIGS. 10, 11 and 12).

The container 10 includes reinforcing features to ensure longevity and to ensure that the container 10 has the required strength for hanging and for supporting other items or containers 10 hanging from it, as described further below with reference to FIGS. 4*a*, 4*b*, 4*c*, 4*d*, 4*e*, 9*a* and 9*b*.

Referring to FIGS. 1, 2 and 3, in the illustrated example, the base 14 is reinforced with piping 36 around the outer edge.

The base portion 22 is reinforced, at the rear, with a plastic insert 38 (shown in dotted lines in FIGS. 2 and 3). The rear wall 20 includes a reinforcing spine 40 (shown in dotted lines in FIG. 3), which extends from the base 14 to the uppermost edge 18 and strengthens the container 10, when it is suspended from, for example a hook or rail and when other items are suspended from the container 10 (as described further below).

In the illustrated example (see FIGS. 2 and 3), the base portion 22 includes three straps 42*a*, 42*b*, 42*c* extending from the base 14 to the upper edge/seam line 44 of the base portion 22.

Figure 4C:
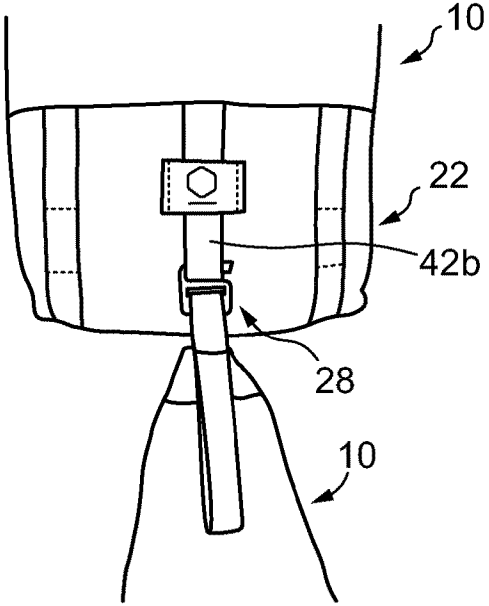
FIGS. 4*a*, 4*b*, 4*c*, 4*d* and 4*e* illustrate how a fastener and loop facilitate hanging the container.

Each strap 42*a*, 42*b*, 42*c* is stitched to the body 12 of the container 10 at both ends and therefore each strap 42*a*, 42*b*, 42*c* defines a loop/sleeve which facilitates suspending other like containers 10 from the straps/loops 42*a*, 42*b*, 42*c* (see FIGS. 4*c*, 9*a* and 9*d*). The central loop 42*b* also facilitates connection of a removable strap assembly 48, which allows conversion of the container 10 to a carry-bag (see FIG. 11).

Figure 4B:
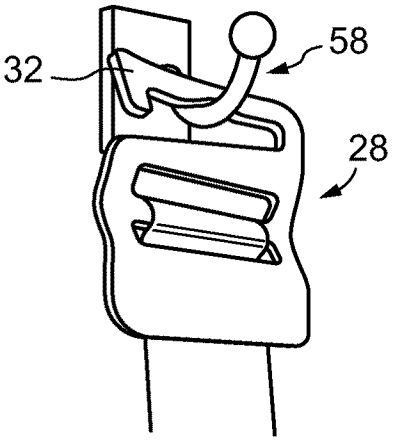

The G-hook 28 can be used directly to hang the container 10 from a hook or loop (see FIGS. 4*b* and 4*c*).

Referring to FIG. 1, in the illustrated example, a further loop 52 is provided at the lower end of the closure member 16. The loop 52 assists in pulling the side walls 26 together as the closure member i.e. the zip 16 is moved to close the front opening to retain objects inside the container body 12. The loop 52 also allows front attachment of a strap assembly 48 to convert the container 10 to a carry-bag (see FIGS. 10, 11 and 12).

In the illustrated example, the exterior fabric 56 of the container body 12 is manufactured from 100% recycled polyester rip stop fabric.

The interior of the body 12 incudes lining material 54, which is 100% recycled polyester artificial silk fabric.

It will be appreciated, the container body 12 can be manufactured from other fabrics/materials, for example leather, organic fabrics, PVC, waterproof treated fabrics etc. Similarly, the lining material 54 could be something other than 100% recycled polyester artificial silk fabric. Indeed, the container body 12 may not be lined.

An advantage of including a lining material 54 is that the reinforcement members 38, 40 can be concealed/sandwiched between the exterior and interior fabric surfaces. This means that stitching along both sides of the reinforcing members 38, 40 creates a region within which the reinforcing members 38, 40 are retained/held in place whilst also concealing them.

In the illustrated example, the spine 40, which reinforces the rear wall 20, is webbing material that can be stitched in place i.e. the stitching passes through the exterior fabric 56, the webbing material (spine 40) and the lining 54 (if used) to ensure the spine 40 remains intact. It will be appreciated the spine 40 may be manufactured from a material other than webbing material, for example the spine 40 may be made of plastic or other suitable fabric. Similarly, the reinforcement in the base portion 22 may be made from materials other than plastic.

In the illustrated example the spine 40 is provided by an elongate piece of flexible material, which is folded to define the loop 29 at one end and a two-layer construction along its length to a second end. The looped end 29 emerges from the uppermost edge 18 and is external to the body 12. The G-hook 28 is attached to the loop 29.

The spine 40 is secured to the body 12 and acts to reinforce the container 10 such that any seams, the fabric of the body 12 and the closure member 16 are not subject to excessive loads when the container 10 is hanging (see FIGS. 4*a* to 4*e*).

In the illustrated example, reinforcing stitches are used to secure the spine 40 to the body 12, for example the spine 40 is secured to the base portion 22 using an arrangement of three rows of stitches i.e. top, middle and bottom relative to the base portion 22.

Including a spine 40 and securing it to the body 12 means when the container 10 is hung directly from the G-Hook 28 or from the doable and undoable loop (described further below with reference to FIG. 4*a*), the weight of the container 10 is carried by the spine 40. As noted above, including reinforcement reduces the risk of body material or any seams being overloaded and prevents premature tearing of the container body material.

FIGS. 4*a*, 4*b*, 4*c*, 4*d* and 4*e* illustrate the function of the G-hook 28 and a rear loop 50, independent of each other or in combination when they make a doable and undoable loop.

The rear loop 50 is provided on the rear of the body 12. In the illustrated example, the rear loop 50 emerges from the uppermost edge 18 of the container 10. The rear loop 50 is secured and reinforced by stitching it to the spine 40 as it emerges from the container 10. This configuration means the container 10 can be hung directly from the rear loop 50 (see FIGS. 4*d* and 4*e*), for example in situations where there is a large knob or hook, which is too large for engagement with the G-hook 28 directly.

Figure 4E:
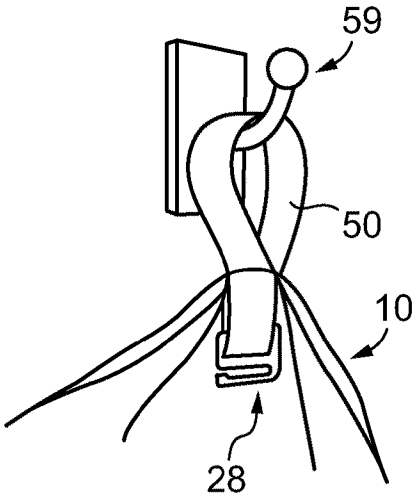
Figure 4A:
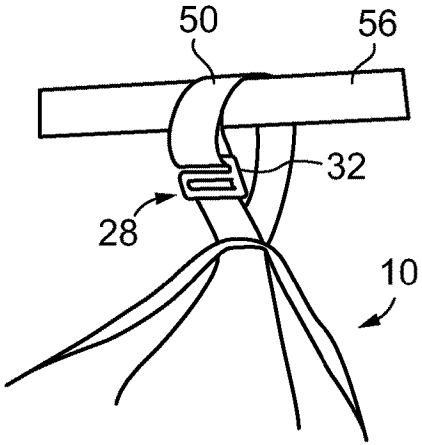
Figure 4D:
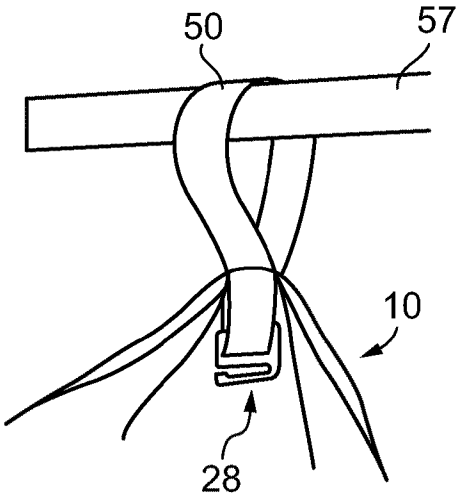

The rear loop 50 facilitates hanging the container 10 independent of the G-hook 28 (see FIGS. 4*d* and 4*e*). The rear loop 50 also doubles as a convenient carry handle or can be used to create a doable and undoable hanging loop in combination with the G-hook 28 (see FIG. 4*a*).

FIG. 4*a* illustrates engagement of the G-hook 28 and rear loop 50 to form a doable and undoable loop, As a doable and undoable hanging loop, the rear loop 50 passes over, for example a rail 56 and engages with the upper hooked portion 32 of the G-hook 28 to facilitate hanging the container 10 from the rail 56.

FIG. 4*b* illustrates the assembly of the G-hook 28 engaging with a simple hook 58, where the upper portion 32 of the G-hook 20 is received directly over the hook 58; for example, the hook 58 may be provided on the rear of a door (not illustrated).

FIG. 4*c* illustrates a container 10 being suspended directly via the G-hook 28 from the central hanging loop 42*b* provided on the base portion 22 (to the rear) of another container 10.

FIG. 4*d* illustrates a container 10 being suspended directly from a rail 57 via the rear loop 50.

FIG. 4*e* illustrates a container 10 being suspended directly from a hook 59 via the rear loop 50. In the illustrated example, the dimensions of the hook 59 may be larger than the open end 32 of the G-hook 28.

Figure 5B:
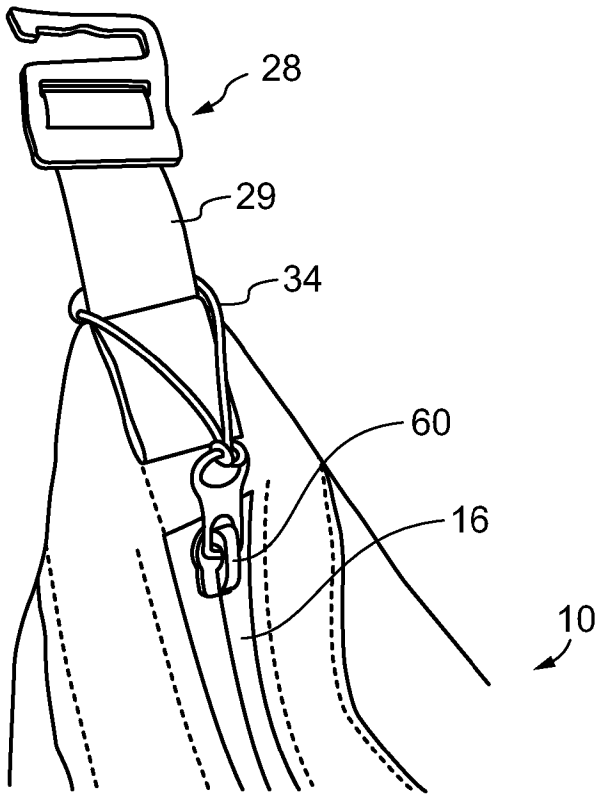
FIGS. 5*a* and 5*b* illustrate how a zip, as an example of a closure member, is locked to prevent inadvertent opening of the container.
Figure 5A:
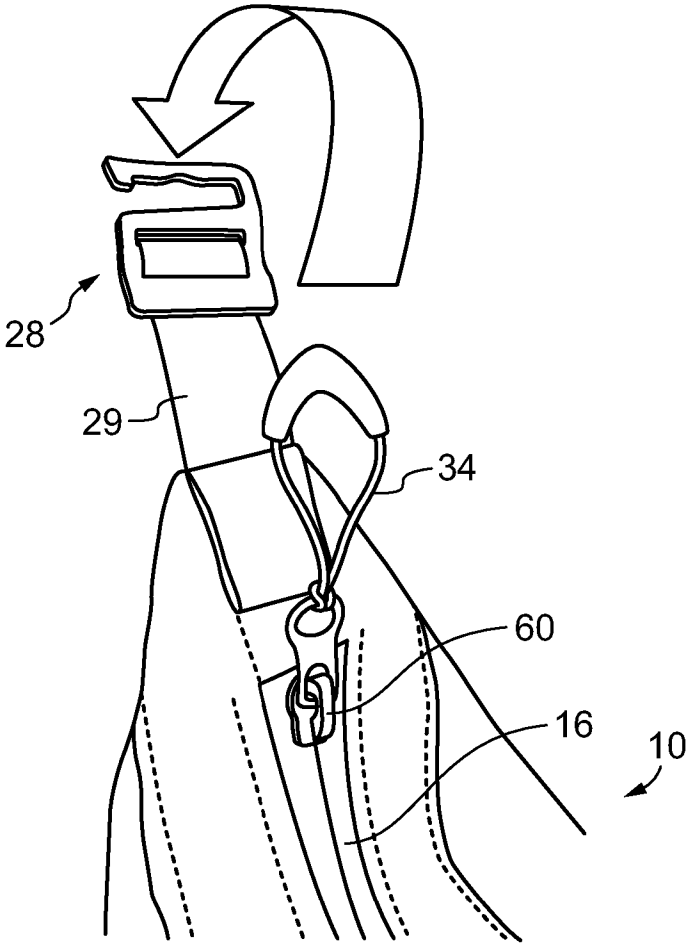

FIGS. 5*a* and 5*b* illustrate an example of the closure member 16 being a conventional zip and where the zip slider 60 includes a customised and extended zip-pull 34. The extended zip-pull 34 is in the form of a loop, which passes over the G-hook 28 and strap 29 towards the rear of the container 10 such that the combination of the G-hook 28 and strap 29 act as a stop, which prevents inadvertent sliding of the slider 60 so prevents inadvertent opening of the zip i.e. closure member 16.

FIGS. 6*a* and 6*b* illustrate an example of two different sized containers 10. In the example illustrated the containers 10 are packed for use as packing capsules in a suitcase (see FIG. 7).

In both FIGS. 6*a* and 6*b* the packing capsules/containers 10 are open to reveal lining material 54 and the interior space 55. In the illustrated example, the smaller packing capsule/container 10 (FIG. 6*a*) is packed with toiletries 62 and the larger packing capsule/container 10 (FIG. 6*b*) is packed with clothing items 64.

As described above, with reference to FIGS. 1 to 3, the packing capsule/container 10 has a substantially cylindrical body 12. Therefore, the interior space 55 is also substantially cylindrical.

In the illustrated example (FIG. 6*b*), the clothing items 64 are rolled to correspond with and efficiently fill the interior space 55. Rolling the items is considered efficient for the particular shape of the container 10 illustrated in FIGS. 1 to 12. Rolling the items is also beneficial because it reduces the creation of crease lines in the clothing items 64 when they are unrolled because no hard crease lines are created.

Figure 7:
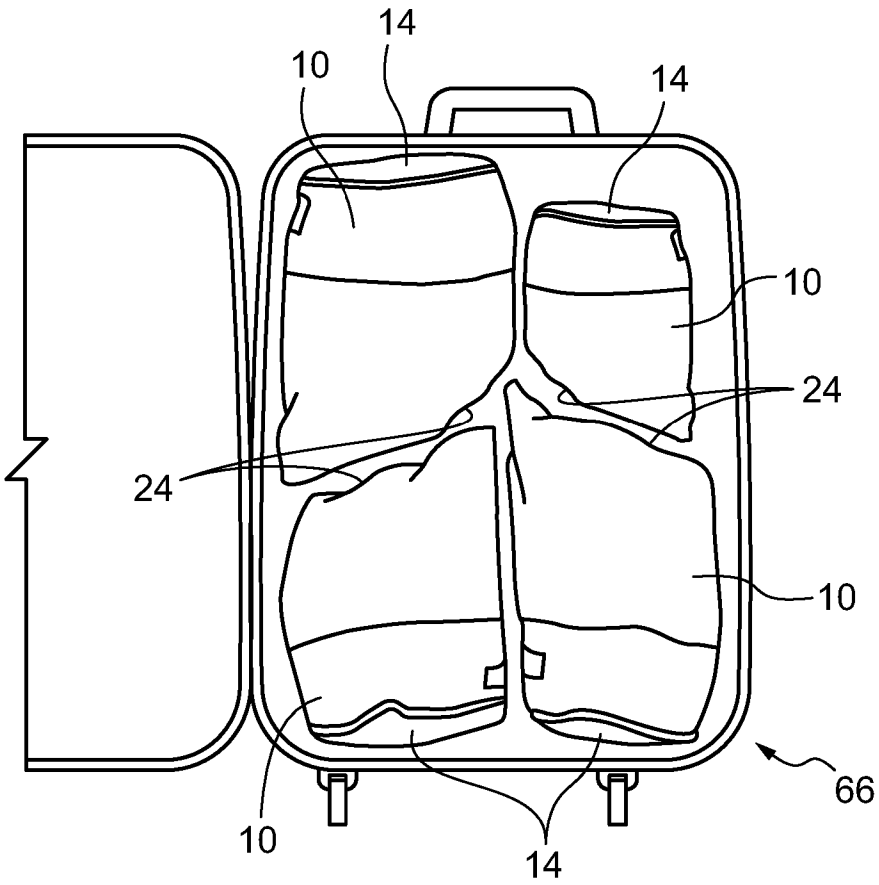
FIG. 7 illustrates an example of the containers of FIGS. 1 and 2 being used as packing capsules, nested within a conventional suitcase.

FIG. 7 illustrates an example of four different sized packing capsules/containers 10 nested in a suitcase 66. In the illustrated example, the base 14 of each packing capsule/container 10 is arranged towards the top or bottom of the suitcase 66 and the front surfaces 24 of adjacent packing capsules/containers 10 are arranged to optimise the space occupied within the suitcase 66 and to minimise any gaps therebetween.

Figure 8:
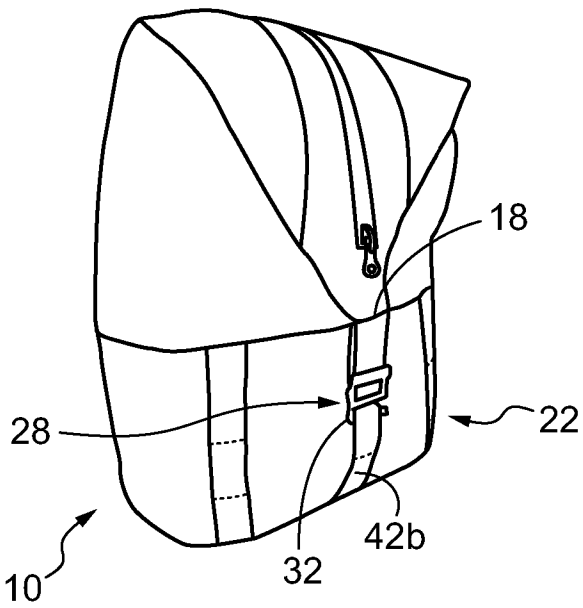
FIG. 8 illustrates an example of folding i.e. reducing the size of the container of FIGS. 1, 2 and 3.

FIG. 8 represents an example of reducing the size of the container 10, for example when it is not full or where the available space in the suitcase is smaller than the fully extended dimension of the container 10.

The size of container 10 is reduced/compressed by folding the uppermost edge 18 rearwards by pulling the G-hook 28 towards the rear base portion 22 and engaging the upper open portion 32 of the G-hook 28 with the rear central loop 42*b* located on the base portion 22.

FIGS. 9*a* and 9*b* illustrate the versatility of the containers 10 when used as packing capsules. They demonstrate unpacking without actually unpacking because in each example it is evident that the packing capsules/containers 10 have been removed from a suitcase, but each packing capsule/container 10 remains packed with rolled clothing items.

FIG. 9*a* illustrates a hanging clump 68, where a single, primary, container 10 is suspended from a hanging rail 56 and three further containers 10 hang from the loops 42*a*, 42*b*, 42*c* (not visible) provided on the rear base portion 22 of the primary container 10.

FIG. 9*b* illustrates a simple chain 69 of packing capsules/containers 10, where a single, primary, container 10 is suspended from a hanging rail 56 and a single container 10 suspends from the primary container 10 via engagement of the G-hook 28 (not visible) with the central hanging loop 42*b* (not visible).

It will be appreciated that the hanging clump 68 and chain arrangement 69 can be extended or combined by utilising the G-hook 28 and the hanging loops 42*a*, 42*b*, 42*c* on the base portion 22 of each container.

The art of unpacking without actually unpacking is realised by the configuration of the packing capsule/container 10 because of the arrangement of the front opening and the closure member 16 and the packing style adopted; rolling the clothing items in the manner illustrated means that when the container 10 is opened each item of clothing is visible and accessible and as noted above the risk of creasing is reduced due to the items being rolled. As such packing and unpacking is simplified using the containers 10 as packing capsules.

FIGS. 10, 11 and 12 relate to converting the container 10 to a carry-bag.

FIG. 10 illustrates an example of a strap assembly 48 that can be utilised with the container 10 to create a carry-bag.

The strap assembly 48 includes an elongated webbing strap 68 which includes a loop 70 at an upper end and a G-hook 80 at a lower end (as viewed in FIG. 10).

The strap assembly 48 also includes a padded shoulder member 72, which incorporates a sleeve 74 through which the strap 68 extends.

The strap 68 includes an adjustable cinch buckle 75 such that the length of the strap 68 can be adjusted to suit different size users.

FIG. 11 illustrates the strap assembly 48 being attached to the back of a container 10. The back mounted configuration involves attaching the G-hook 28 (on the container 10) to the upper loop 70 and attaching the G-hook 80 (on the lower end of strap 68) to the central loop 42*b* on the rear of the base portion 22.

FIG. 12 illustrates the strap assembly 48 being attached to the front of a container 10. The front mounted configuration involves attaching the G-hook 28 (on the container 10) to the upper loop 70 and attaching the G-hook 80 (on the lower end of strap 68) to the loop 52 located at the bottom of the closure member/zip 16.

It will be appreciated in each of the examples illustrated in FIGS. 11 and 12 the cinch buckle 75 or the like can be used to adjust the length of the strap 68 for comfort for each user. The strap assembly 48 allows for the carry-bag to be carried across the user's body or over the user's shoulder.

Figure 13:
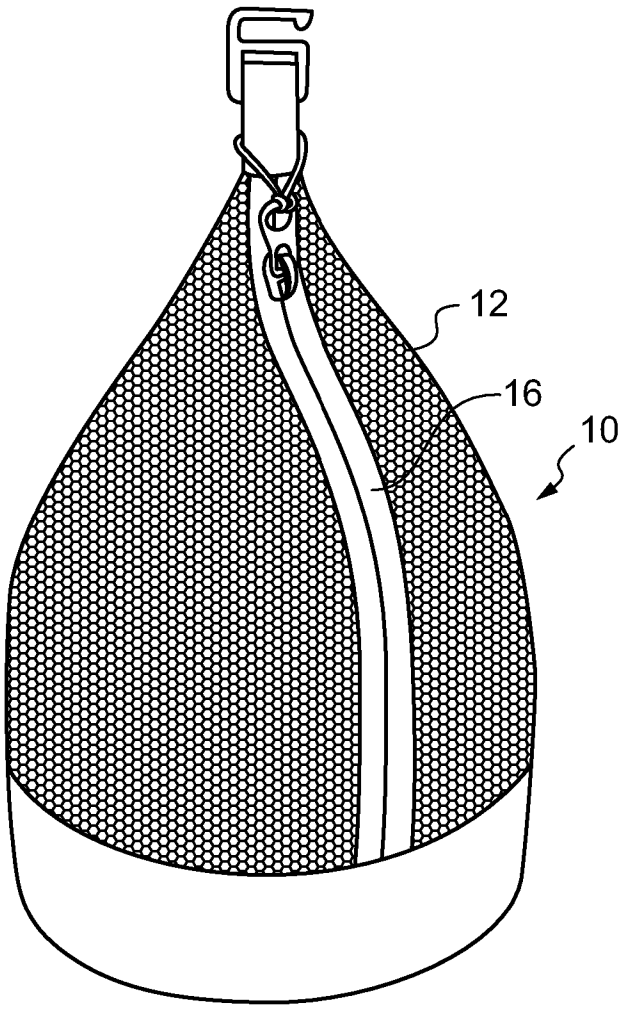
FIG. 13 illustrates the container as illustrated in FIGS. 1 to 12 as a laundry bag, which includes a breathable mesh body.

FIG. 13 illustrates a laundry bag as an example application of the container 10. In the configuration illustrated, the container 10 includes a body 12 comprising a single layer of material. In the illustrated example, the material is semi-transparent mesh fabric, which enables the user to view the contents inside the container 10 without opening the closure member 16. In addition, the mesh fabric is configured to allow air to circulate through and in the container 10 and its contents thereby preventing build up of moisture, creation of mould etc within the container 10 and/or its contents.

Figure 14:
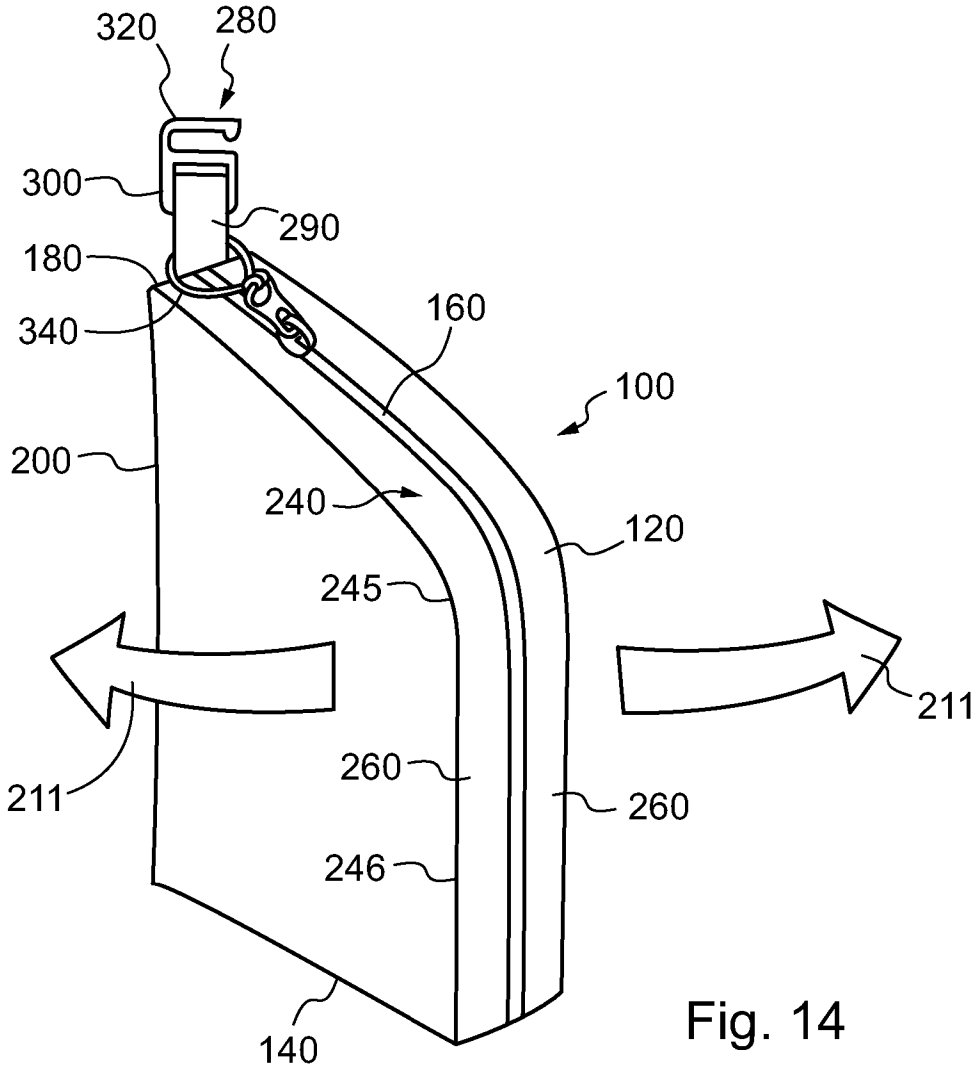
FIG. 14 illustrates a further example of a slim-line container, in a closed configuration.
Figure 15:
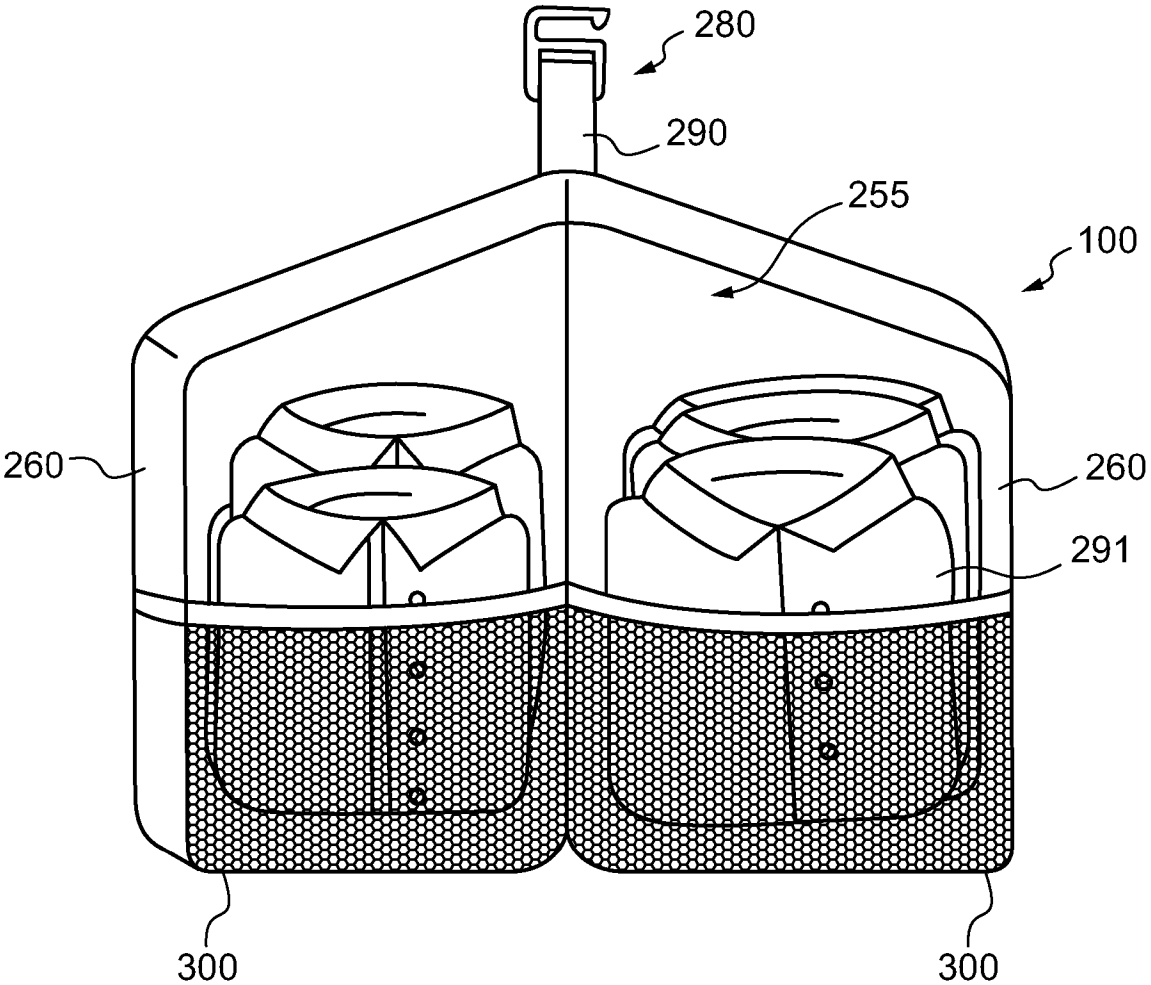
FIG. 15 illustrates the container as illustrated in FIG. 14 in a fully open configuration.
Figure 16:
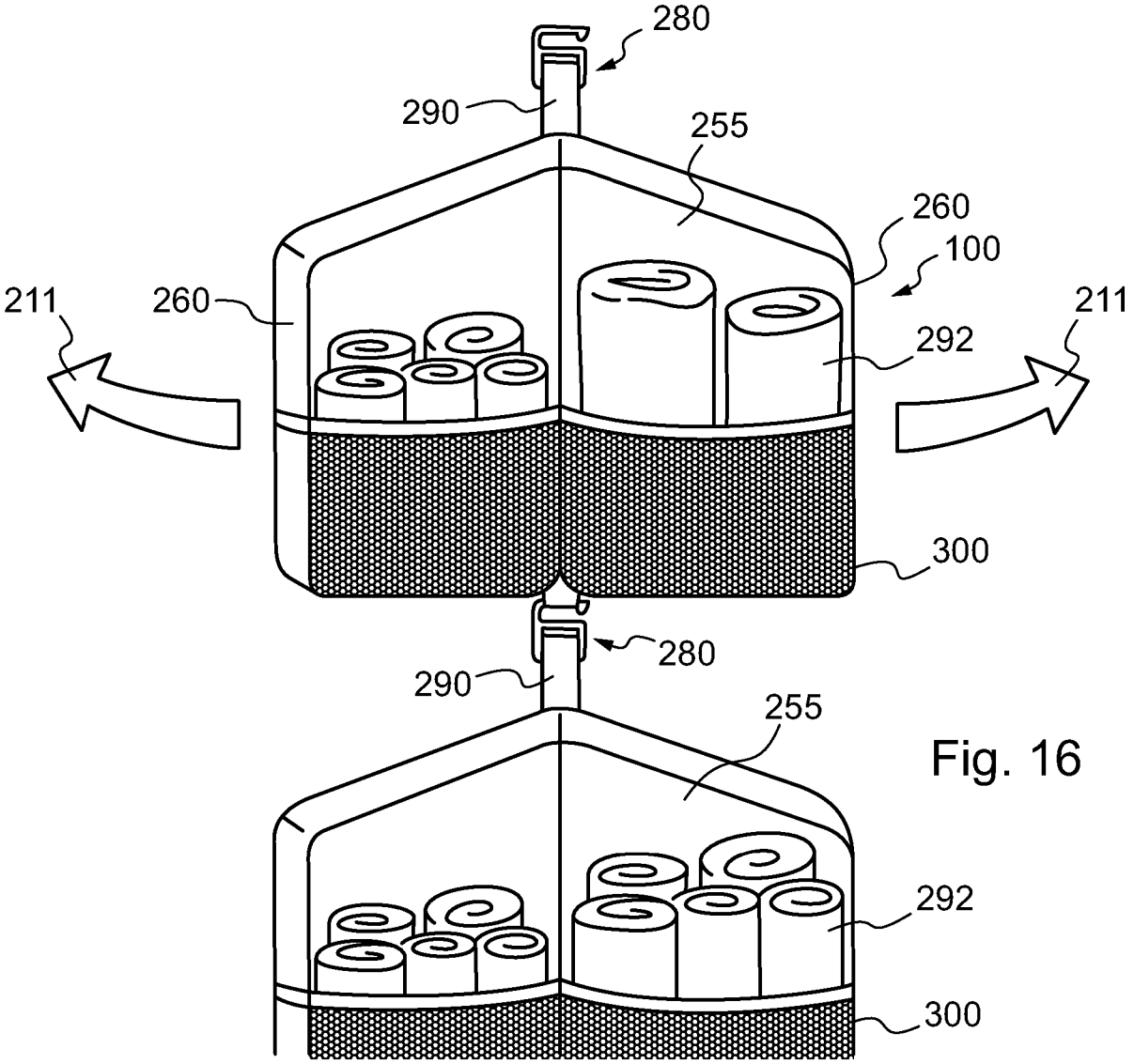
FIG. 16 illustrates a hanging arrangement of two containers as illustrated in FIG. 14.

FIGS. 14, 15 and 16 illustrate a container 100, which is narrower than the container 10 (illustrated in FIGS. 1 to 12).

The container 100 includes a narrow/slim-line columnar body 120 extending from a base 140. In the illustrated example, the base 140 is elliptical (not visible in FIG. 14).

The container 100 is made of flexible material. An example application of the container 100 is that it is configurable as a packing capsule for efficient packing of suitcases and the like.

The body 120 defines an interior space 155 configured to contain one or more objects 156 (see FIGS. 15 and 16).

The interior space 155 is accessed by a front opening, which is closed by a closure member 160, which, in the illustrated example is provided by a zip. In the illustrated example the closure member 160 extends from an uppermost edge 180 along the front opening, across the base 140 to a point towards/at the rear of the base 140.

In the illustrated example, the front surface 240 of the container 100 is, substantially continuous, tapering from the uppermost edge 180 and transitioning by a curve 245 to a substantially vertical portion 246 of the front surface 240, which extends to the base 140. The closure member 160 is located substantially central to the front surface 240.

The uppermost edge 180, is formed by the junction of the rear wall 200 and the front surface 240. A loop 290 emerges from the uppermost edge 180. In the illustrated example a G-hook 280 is attached to the loop 290.

The G-hook 280, as described above with reference to FIGS. 1 to 13, is a fastener which when viewed resembles a letter G or a number 6, where the lower closed/semi closed portion 300 of the G-shaped hook 280 is permanently attached to the container 100 via the loop 290 that passes through the lower closed/semi closed portion 300 of the G-shape. The upper hooked portion 320 of the G-shaped hook 280 facilitates hanging the container 100 from a rail, hook or other container 100 (see FIG. 15) and securing the zip pull 340 (see FIG. 14).

In the illustrated example, the closure member 160, when open, provides access to the interior space 155 and any contents therein. The front opening is defined by two side walls 260, which when partially opened, fold back on themselves (not illustrated), but when fully open the side walls open like a book (see arrows 211) to reveal the entire contents of the inner space 255 (see FIGS. 15 and 16).

Referring to FIGS. 15 and 16, the container 100 includes internal pockets/compartments 300 on the inside of each side wall 260. The internal pockets/compartments 300 facilitate holding objects or clothing as illustrated. FIG. 15 illustrates folded shirts 291 contained in each pocket 300 and FIG. 16 illustrates cylindrical objects or rolled items 292 contained in each pocket 300.

FIG. 16 illustrates a chain of containers 100, where one container 100 is suspended from a primary container 100 via the G-hook 280 and a rear loop (not visible in FIG. 16).

FIGS. 17 to 24 illustrate examples of accessories, which adapt, customise or specialise the functionality, of the container 10 or container 100 described above with reference to FIGS. 1 to 16.

Figure 17:
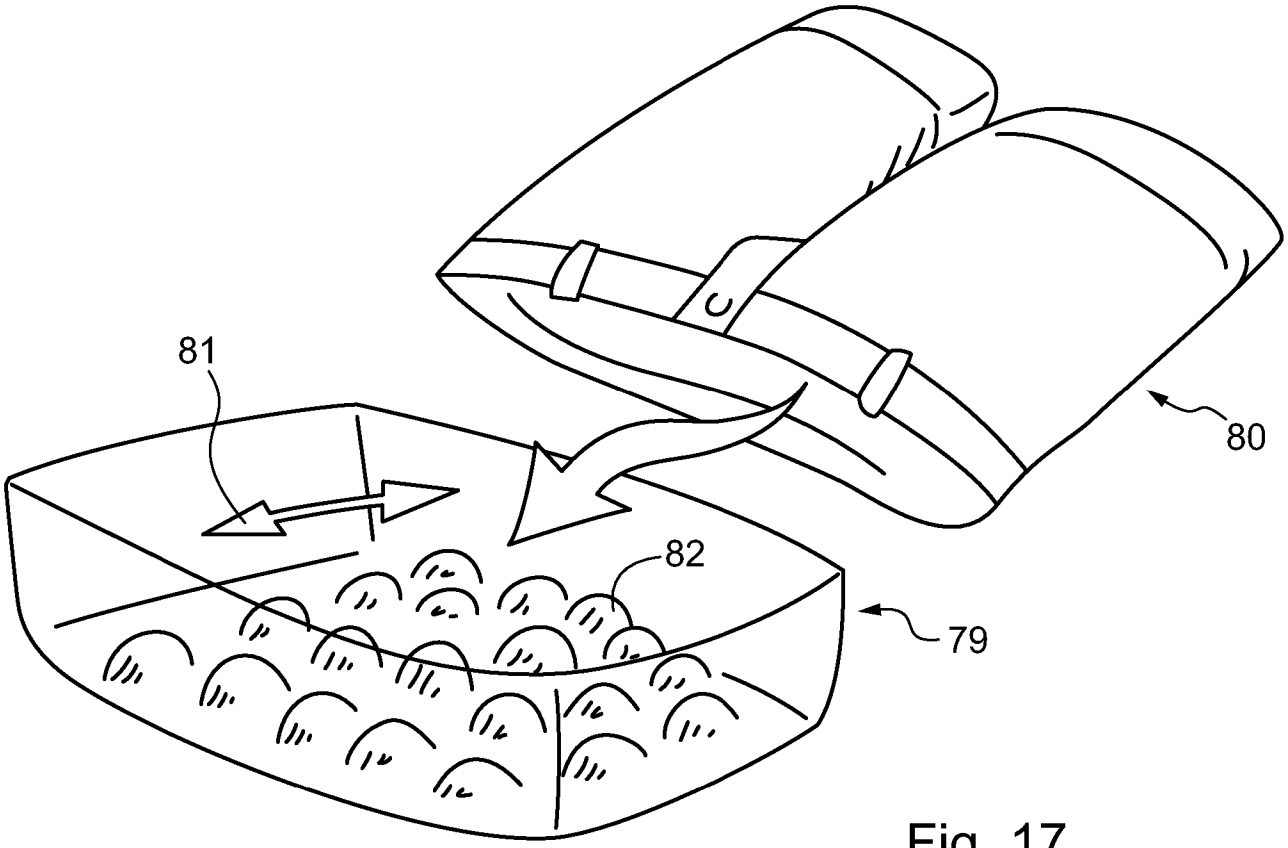
FIG. 17 illustrates an example of a washing accessory which facilitates the container for washing items.

FIG. 17 illustrates a way to adapt the base portion 22 of container 10 by representing a removable insert 79 which can be included with the container 10 to facilitate hand-washing garments 80 whilst travelling or on holiday. In the illustrated example, the insert 79 includes raised elements 82 that facilitate agitating clothes (see double-headed arrow 81) e.g. hand washing on the go. The insert 79 may be manufactured as a moulded dimpled insert; for example, the moulding may be silicon, plastic etc.

Figure 18:
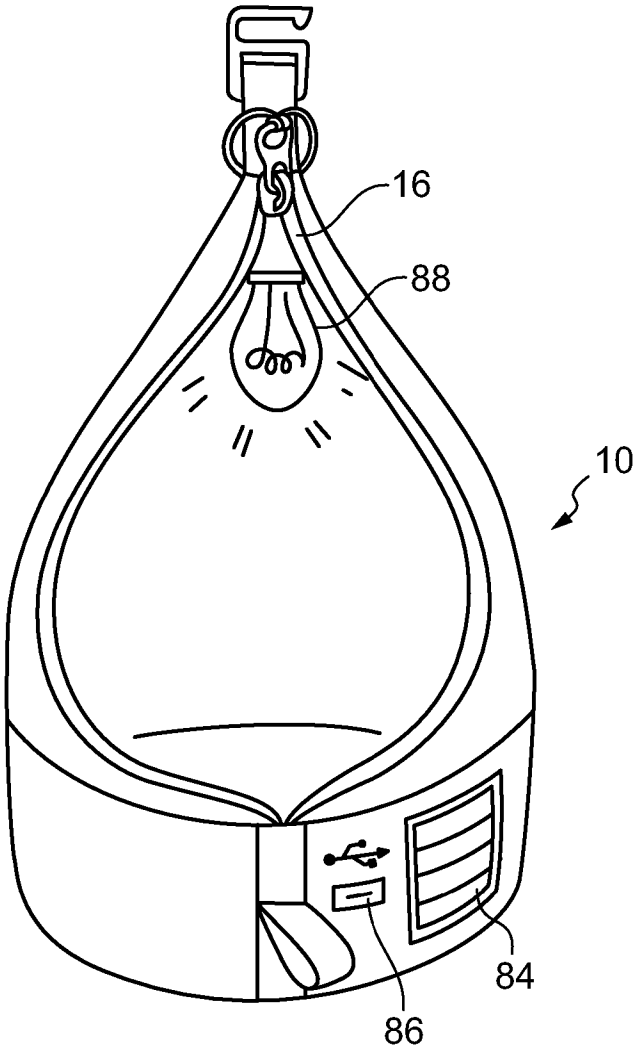
FIG. 18 illustrates the container of FIGS. 1 to 12 incorporating lighting and charging facilities.

FIG. 18 illustrates the container 10 being adapted to include a self-contained charging facility for powering/charging phones, lights etc.

In the illustrated example, an outside wall of the container 10 includes a solar panel 84, and conventional USB port 86. The solar panel 84 facilitates charging internal or encased battery packs (not visible), which are connected to the USB port 86 to facilitate charging mobile devices, such as phones, tablets etc.

In the illustrated example, inside the container 10 includes a light source 88, for example embedded low power LEDs or electroluminescent strips, which when illuminated aid viewing inside the container 10 and its contents in the dark.

The light source 88 could be motion activated, such that it only switches on/illuminates when the container 10 is swung. Alternatively, activation of the light source could be controlled by opening the closure member 16.

FIGS. 19, 20, 21, 22, 23 and 24 illustrate adapting the container 10 to include removable accessories for organisation of specific items.

Figure 19:
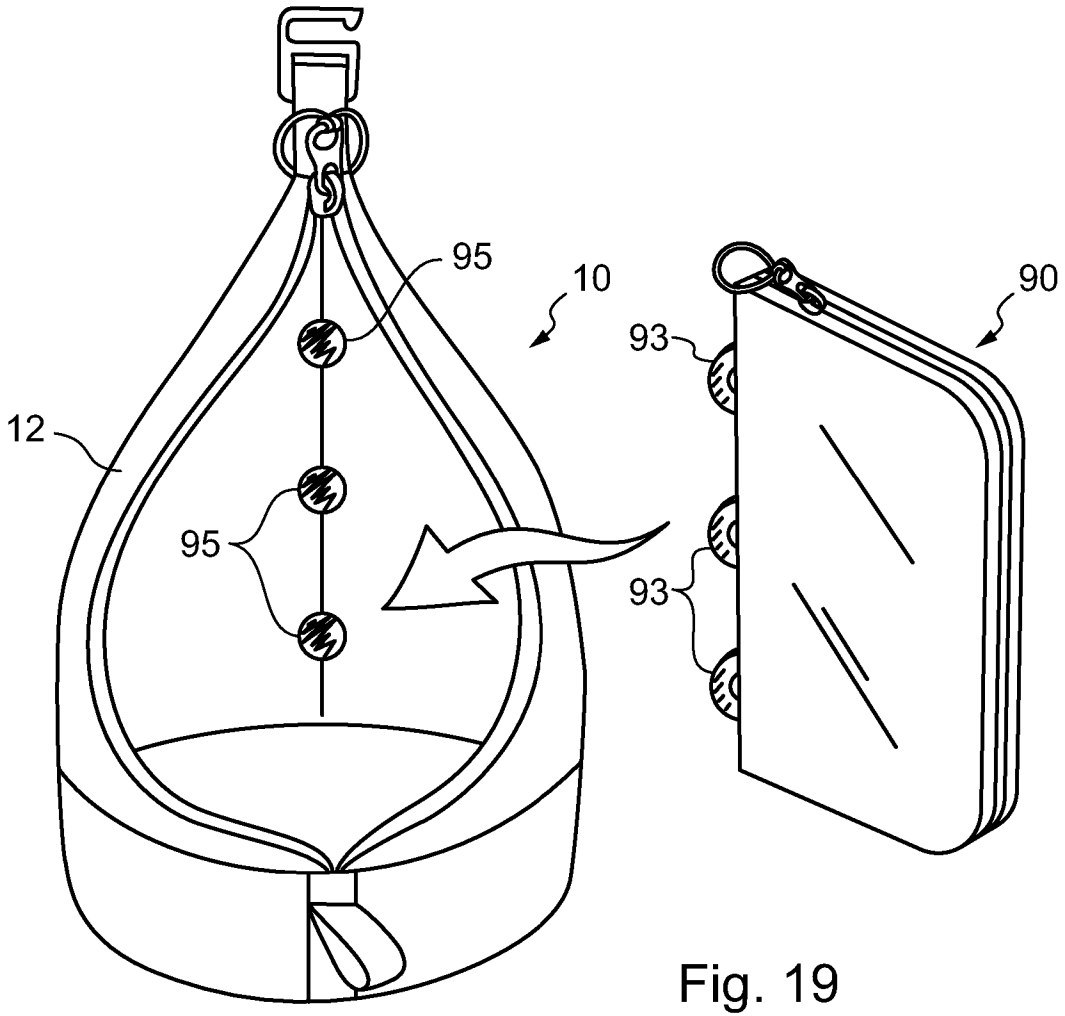
FIG. 19 illustrates an internal accessory facilitating attaching and detaching accessories to and from inside the container.
Figure 21:
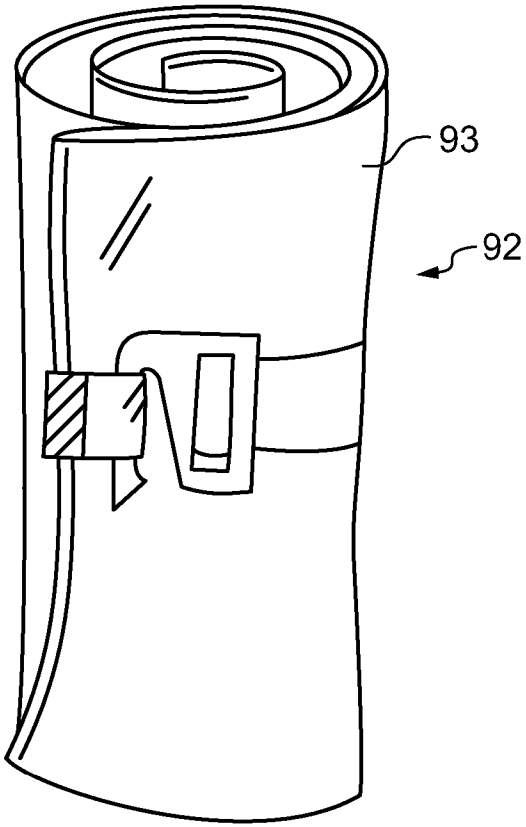
FIGS. 20, 21, 22, 23 and 24 illustrate examples of accessories that can be used with the illustrated containers.
Figure 20:
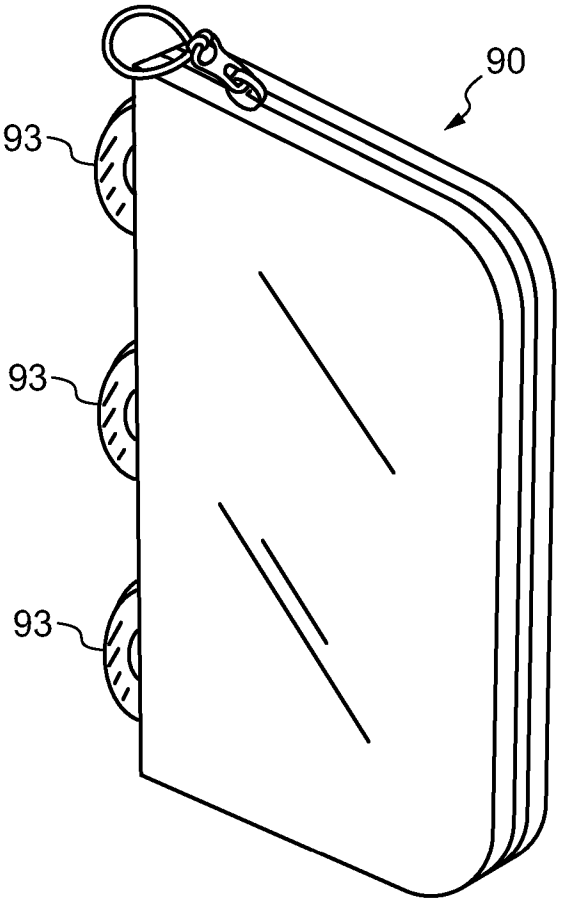
Figure 23:
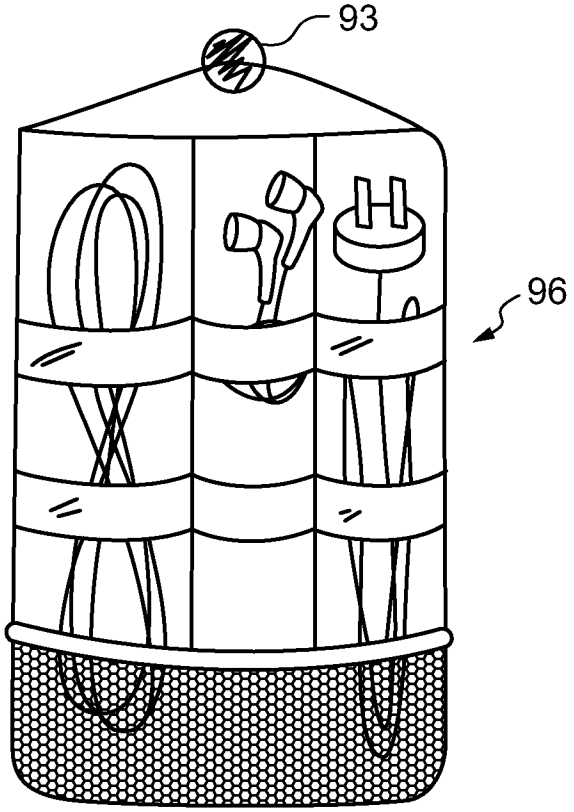
Figure 22:
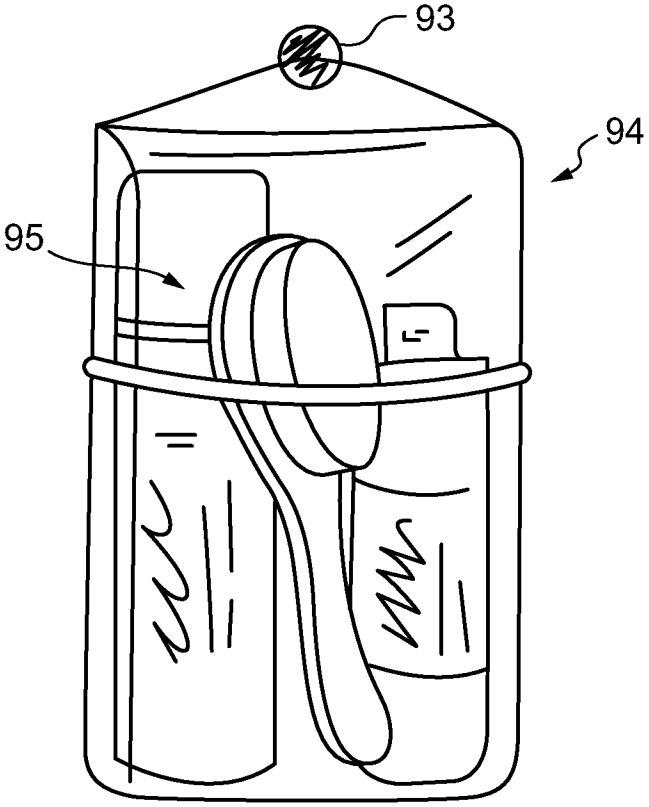

Removable accessories include, for example:

a laptop/tablet case 90 (see FIGS. 19 and 20);

a make-up/cosmetic roll 92 (see FIG. 21), which comprises a sheet of fabric 93, which can be rolled, and which includes integrated slots/pockets (not visible) designed to accommodate and organise make-up items 95 e.g. make up brushes, nail files, mascara, lip stick, cotton buds etc.;

a transparent pouch 94 (TSA approved) (see FIG. 22) configured to contain toiletries that need to be removed and displayed when going through airport security;

a board or pouch 96 (see FIG. 23) configured with elastic straps, loops and pockets to secure and organise electric cables, headphones, chargers and power cables;

a rigid plastic divider 98 (see FIG. 24) to organise cooking utensils, for example while camping;

a removable mirror (not illustrated);

a waterproof pouch (not illustrated) configured to contain wet swimming items, towel, shoes etc.

Each of the removable accessories described and illustrated may include connectors 93, which engage with complementary connectors 95 on the inside of the body 12. The connectors 93, 95 may include magnets, press-studs, g-hooks and loops, hook and loop fastening tape etc.

The containers 10, 100 described above, may also include internal and/or external pockets (not illustrated). The pockets may be concealed by the nature of the construction of the body, where seams may include concealed zips or closures for pockets accessible from outside the body or from inside the body 12, 120.

The examples described above relate to a container 10, 100, which is described as being suitable as a packing capsule to facilitate more efficient packing of a suitcase, holdall or the like.

It will be appreciated that the application of such a container/bag 10, 100 is not limited to a packing accessory, but may be useful in other applications, for example medical usage e.g. paramedic emergency crash bags, military, hobbies e.g. cycling and useful to carry equipment such as spare inner tubes, pump, cycle tools, patches, energy gels/food etc.

Figure 24:
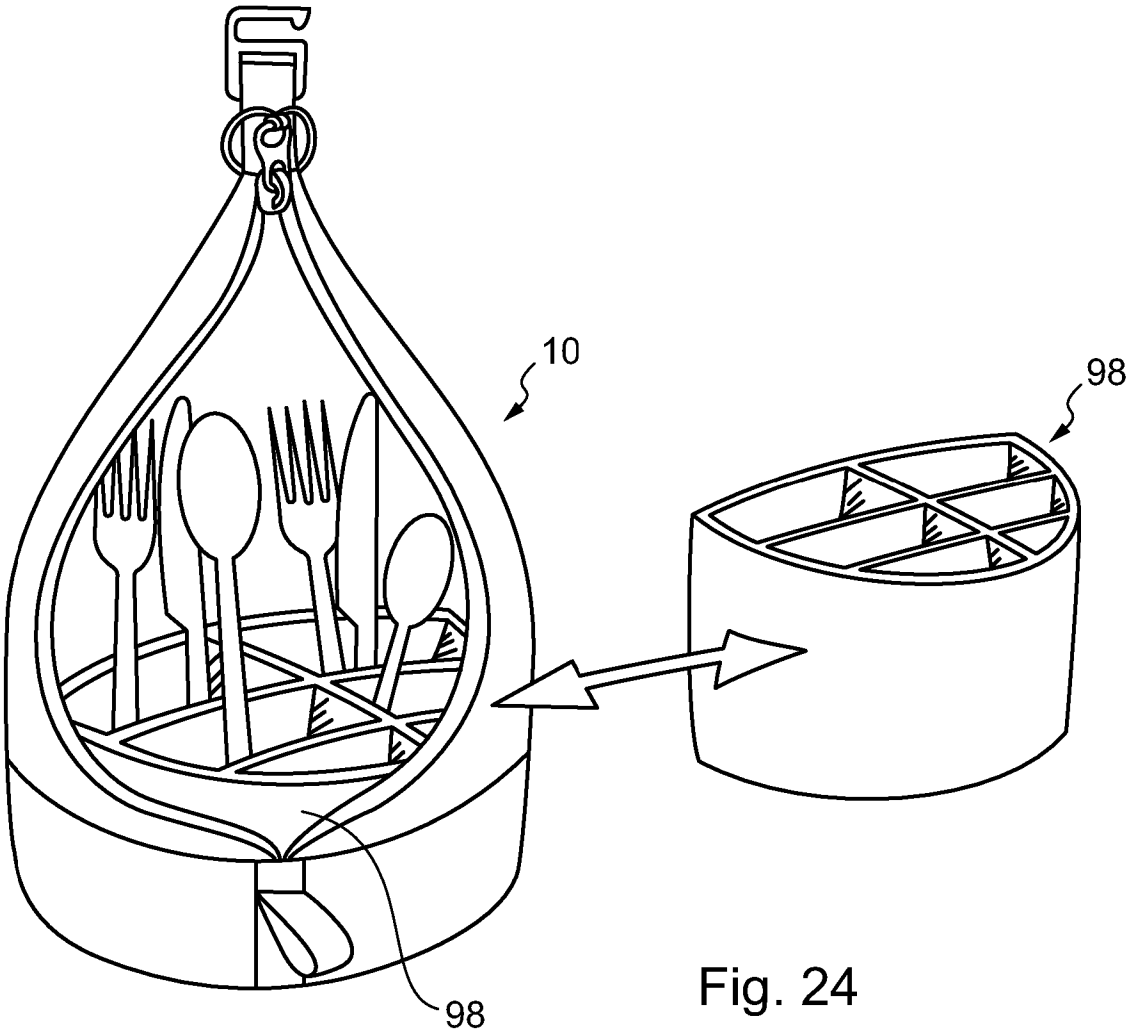

As illustrated in FIG. 24, the container may be useful as a camping accessory, for utensils, but it will be appreciated that other items could be stored, for example food items. An advantage of the container 10 being that it can be hung via the G-hook 28 and/or the rear strap 50, which means such items can be kept off the ground and are easily accessible at the same time.

Portability of the container 10, 100 makes it useful for use when travelling e.g, in an aeroplane, car, bus etc, where it can be used as a seat organiser for the journey where the container 10, 100 can simply hang from a seat in front for ease of access to the contents.

In a boat the container 10, 100 could be used as an organiser at the tiller/wheel.

Other examples include useful storage and organising elements at home, work or play.

While specific embodiments of the present invention have been described above, it will be appreciated that departures from the described embodiments may still fall within the scope of the present invention.

The invention claimed is:

1. A container of flexible material comprising:

a body extending from a base, wherein the body defines an interior space configured to contain one or more objects;

wherein:

the body is configurable between an extended configuration and a folded configuration;

the body includes a front opening, which includes an elongate closure member extending from a point proximate an uppermost edge of the body in the extended configuration to a point proximate the base, wherein the closure member bridges two side portions of the body such that when the closure member is at least partially open the two side portions are displaceable relative to each other, towards a rear wall, to provide access to inside the body;

the uppermost edge of the body, in the extended configuration, includes a fastener;

a base portion of the rear wall includes at least one external strap, where the at least one strap extends substantially vertically relative to the base, wherein the at least one strap is secured at least at two points, thereby defining a void between the strap and the base portion of the rear wall;

the rear wall of the container comprises an elongate spinal member, wherein the elongate spinal member extends from another point proximate the base to the uppermost edge of the body; and the elongate spinal member comprises an elongate piece of flexible material doubled to define a loop at a first end and a two-layer construction along its length to a second end.

2. A container as claimed in claim 1, wherein the two side portions are operable to be folded back on themselves to allow access to inside the body.

3. A container as claimed in claim 1, wherein the fastener comprises a hook, or a G-hook.

4. A container as claimed in claim 1, wherein the elongate spinal member extends from a point at least partially across the base to the uppermost edge of the body.

5. A container as claimed in claim 1, wherein the first end comprising the loop emerges from the body proximate the uppermost edge to be external to the body.

6. A container as claimed in claim 1, wherein the fastener is attached to the loop.

7. A container as claimed in claim 1, wherein the second end is secured to at least a base portion of the body.

8. A container as claimed in claim 1, wherein the second end extends to a point at least partially across the base and the second end is secured to the base.

9. A container as claimed in claim 1, wherein at least a lower portion of the rear wall includes a reinforcing member which extends across substantially a width of the rear wall.

10. A container as claimed in claim 1, wherein an upper section of the rear wall includes a flexible loop external to the body proximate the uppermost edge.

11. A container as claimed in claim 10, wherein the flexible loop emerges from the uppermost edge and is secured at one end to the body and includes a looped free end.

12. A container as claimed in claim 11, wherein the looped free end is configured to be engageable with a fastener thereby, when engaged, the fastener and looped free end create a doable and undoable loop.

13. A container as claimed in claim 1, wherein the base is rounded, or substantially circular, or substantially elliptic.

14. A container as claimed in claim 1, wherein a rear portion of the base is substantially flat, thereby defining a substantially flat rear wall extending up from the base.

15. A container as claimed in claim 1, wherein the rear wall is tapered from the base portion to the uppermost edge, wherein the uppermost edge is narrower than the base.

16. A container as claimed in claim 1, wherein the body includes a substantially continuous front surface, which is defined by a slope, which transitions to a substantially vertical wall extending up from the base and wherein the closure member is located substantially central on the front surface.

17. A container as claimed in claim 1, further comprising a removable strap assembly, which includes at one end a fastener compatible with the fastener located at the uppermost edge of the rear wall and a fastener configured for forward or rear attachment to the container.

18. A packing capsule comprising a container according to claim 1.

19. A container as claimed in claim 1, wherein the base portion of the rear wall includes a plurality of external straps each extending substantially vertically relative to the base, wherein each strap is secured at least at two points thereby defining a void between each strap and the base portion of the rear wall.

20. A container as claimed in claim 1, wherein the body is a columnar body extending from the base.

21. A container of flexible material comprising:

a body extending from a base, wherein the body defines an interior space configured to contain one or more objects; wherein:

the body is configurable between an extended configuration and a folded configuration;

the body includes a front opening, which includes an elongate closure member extending from a point proximate an uppermost edge of the body in the extended configuration to a point proximate the base, wherein the closure member bridges two side portions of the body such that when the closure member is at least partially open the two side portions are displaceable relative to each other, towards a rear wall, to provide access to inside the body;

the uppermost edge of the body, in the extended configuration, includes a fastener;

a base portion of the rear wall includes at least one external strap, where the at least one strap extends substantially vertically relative to the base, wherein the at least one strap is secured at least at two points, thereby defining a void between the strap and the base portion of the rear wall;

an upper section of the rear wall includes a flexible loop external to the body proximate the uppermost edge; and the flexible loop emerges from the uppermost edge and is secured at one end to the body and includes a looped free end.

22. A container as claimed in claim 21, wherein the looped free end is configured to be engageable with the fastener thereby, when engaged, the fastener and looped free end create a doable and undoable loop.

23. A container as claimed in claim 21, wherein the two side portions are operable to be folded back on themselves to allow access to inside the body.

24. A container as claimed in claim 21, wherein the fastener comprises a hook, or a G-hook.

25. A container as claimed in claim 21, wherein at least a lower portion of the rear wall includes a reinforcing member which extends across substantially a width of the rear wall.

26. A container as claimed in claim 21, wherein the base is rounded, or substantially circular, or substantially elliptic.

27. A container as claimed in claim 21, wherein a rear portion of the base is substantially flat, thereby defining a substantially flat rear wall extending up from the base.

28. A container as claimed in claim 21, wherein the rear wall is tapered from the base portion to the uppermost edge, wherein the uppermost edge is narrower than the base.

29. A container as claimed in claim 21, wherein the body includes a substantially continuous front surface, which is defined by a slope, which transitions to a substantially vertical wall extending up from the base and wherein the closure member is located substantially central on the front surface.

30. A container as claimed in claim 21, further comprising a removable strap assembly, which includes at one end a fastener compatible with the fastener located at the uppermost edge of the rear wall and a fastener configured for forward or rear attachment to the container.

31. A packing capsule comprising a container according to claim 21.

32. A container as claimed in claim 21, wherein the base portion of the rear wall includes a plurality of external straps each extending substantially vertically relative to the base, wherein each strap is secured at least at two points thereby defining a void between each strap and the base portion of the rear wall.

33. A container as claimed in claim 21, wherein the body is a columnar body extending from the base.

* * * * *